United States Patent [19]

Tsisios et al.

[11] Patent Number: 4,728,777

[45] Date of Patent: Mar. 1, 1988

[54] GRILLING ARRANGEMENT

[75] Inventors: Michael N. Tsisios, London; Robert D. Smith, Cheshunt, both of England

[73] Assignee: Thorn EMI Appliances Limited, London, England

[21] Appl. No.: 904,609

[22] Filed: Sep. 8, 1986

[30] Foreign Application Priority Data

Sep. 18, 1985 [GB] United Kingdom ..... 8523027

[51] Int. Cl.[4] ..... H05B 6/00

[52] U.S. Cl. ..... 219/348; 219/354; 219/405

[58] Field of Search ..... 219/347, 348, 354, 405, 219/411, 352, 357, 382

[56] References Cited

U.S. PATENT DOCUMENTS

| | | | |
|---|---|---|---|
| 3,108,173 | 10/1963 | Barrett et al. | 219/352 |
| 3,355,574 | 11/1967 | Bassett | 219/352 |
| 4,083,357 | 4/1978 | Fischer | 126/438 |
| 4,198,560 | 4/1980 | Dietrich | 219/348 |
| 4,486,639 | 12/1984 | Mittelsteadt . | |
| 4,532,455 | 7/1985 | Connor et al. | 313/579 |
| 4,551,616 | 11/1985 | Buttery | 219/354 |

FOREIGN PATENT DOCUMENTS

| | | | |
|---|---|---|---|
| 25042 | 7/1906 | Austria . | |
| 545148 | 6/1956 | Italy | 219/352 |
| 149250 | 11/1979 | Japan | 219/348 |
| 1174610 | 12/1969 | United Kingdom . | |

*Primary Examiner*—Carroll B. Dority, Jr.

*Attorney, Agent, or Firm*—Fleit, Jacobson, Cohn & Price

[57] ABSTRACT

A grilling arrangement comprises a compartment including two tungsten-halogen lamps mounted adjacent the top of the compartment behind a screen of infra-red-transmissive material. The lamps are emissive of infra-red radiation, which grills food supported on a shelf in the compartment. Each lamp has a reflector, which is preferably parabolic in cross-section, to reflect infra-red radiation from the lamps onto the grilling surface. A control arrangement is also provided to impart oscillatory movement to the reflectors and lamps, so that infra-red radiation from the lamps is swept across the grilling surface, thereby achieving a substantially uniform distribution of intensity of infra-red radiation over the surface over a given length of time.

7 Claims, 3 Drawing Figures

GRILLING ARRANGEMENT

This invention relates to a grilling arrangement and in particular, though not exclusively, to such an arrangement including a number of tungsten-halogen lamps for generating infra-red radiation for grilling food.

The use of tungsten-halogen lamps for grilling has been previously proposed in our copending U.K. Patent Application No. 8320717 (Publication No. 2132060A), wherein each lamp comprises a tubular quartz envelope, within which a tungsten filament is supported.

Although the use of such lamps in cooking apparatus, such as cooking hobs, grills, etc, has been found to be highly efficient, giving a usefully rapid thermal response time, the lamps tend to generate a non-uniform spatial distribution of intensity of infra-red radiation and thus can cause disadvantages when used for grilling, since the non-uniform spatial distribution of intensity can cause non-uniform grilling of food.

It is therefore an object of the present invention to provide a grilling arrangement, which alleviates the problem of non-uniform grilling of food.

According to the present invention there is provided a grilling arrangement including a grilling surface for supporting food to be grilled, a source of infra-red radiation for grilling said food, means for reflecting infra-red radiation generated by said source towards said grilling surface, and means for imparting movement to said reflecting means so that said reflected radiation is swept across said surface to enhance the uniformity of distribution of intensity of infra-red radiation over said surface over a predetermined length of time, as compared with the degree of said uniformity that would prevail in the absence of said movement of said reflecting means.

Preferably, the reflecting means comprises a reflector which is parabolic in cross-section with the infra-red source at the focus of the parabola, and the reflector is preferably oscillated about an axis at the peak of the parabolic cross-section.

Preferably, the position of the infra-red source relative to the reflecting means is fixed, so that the infra-red source moves with the reflecting means.

It is also preferable that the infra-red source is a tubular tungsten-halogen lamp, having its tungsten filament at the focus of the reflector, and the reflector extends along the length of the lamp.

In a preferred embodiment, two tubular tungsten-halogen lamps, each having an oscillatory parabolic reflector associated therewith, are mounted behind a screen of infra-red transmissive material to provide protection for the lamps.

Figure 1:
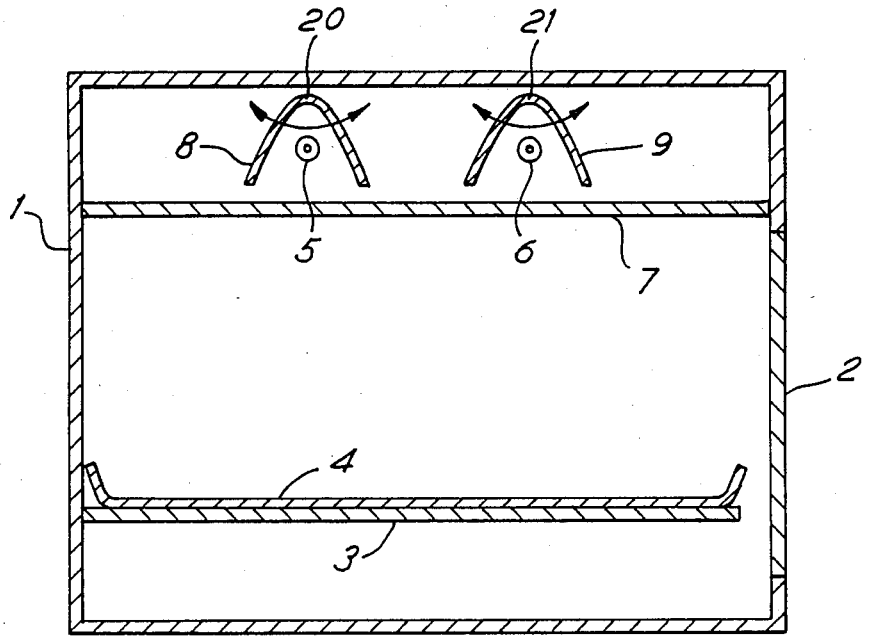
Figure 2:
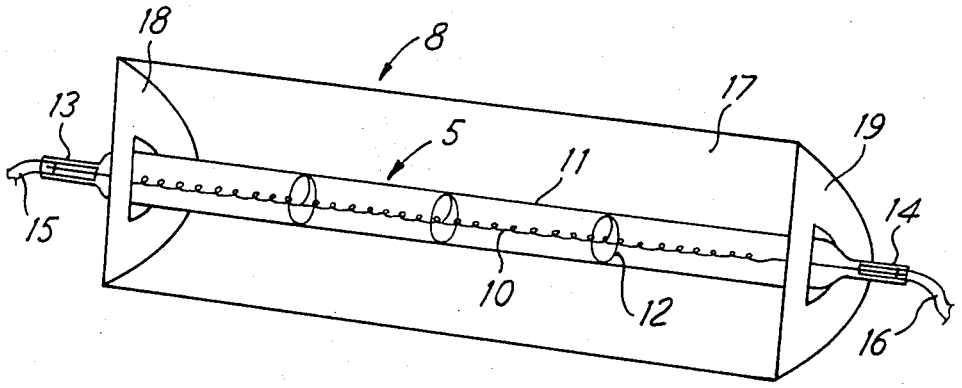
Figure 3:
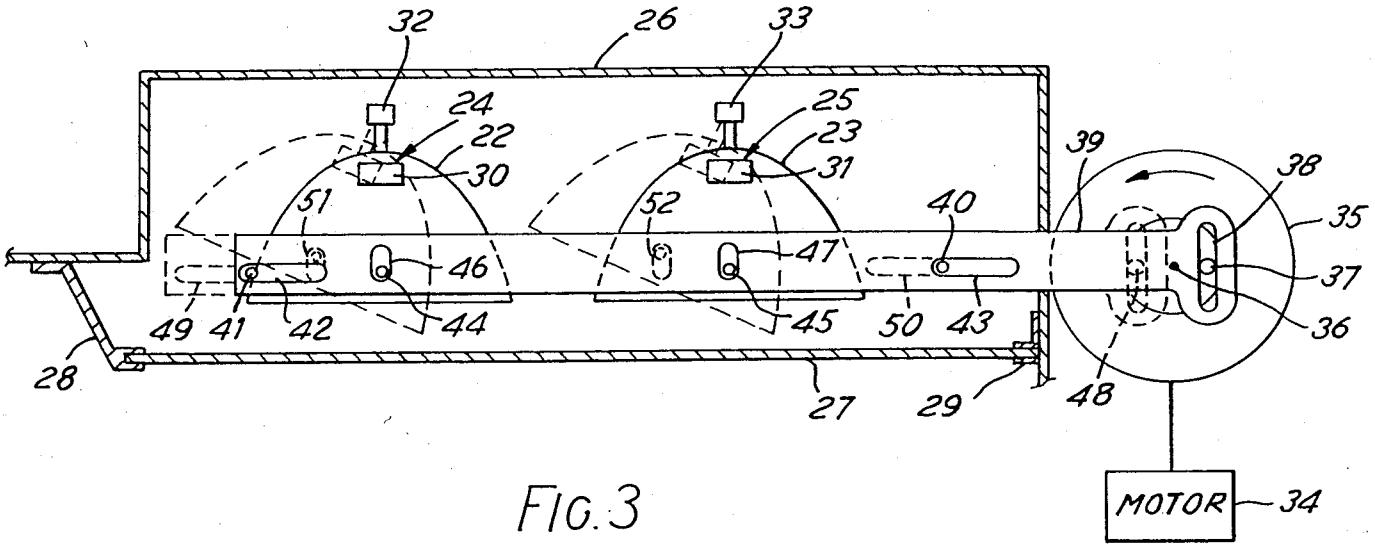

The invention will now be further described by way of example only with reference to the accompanying drawings, wherein:

FIG. 1 shows schematically a cross-sectional view of one embodiment of the invention, FIG. 2 shows an enlarged perspective view of a lamp and associated reflecting means, as shown in FIG. 1, and FIG. 3 schows schematically an end view of a suitable arrangement for controlling movement of the reflecting means and lamps.

FIG. 1 shows a grilling compartment 1, which is preferably part of a cooker (not shown) having an oven below the compartment and a cooking hob above it. A door 2 is provided in the front of the compartment 1. A shelf 3 is preferably removable from the compartment 1 and selectively positionable within the compartment at a number of predetermined heights by, for example, suitable ridges (not shown) in the side walls of the compartment.

Grilling of food, supported either directly on the shelf 3 or in a suitable dish or tray 4 placed on the shelf, is achieved by a number, preferably two, tungsten-halogen lamps 5,6, as sources of infra-red radiation, mounted adjacent the top of the compartment 1 behind a screen 7 of a material, such as a glass ceramic, which is transmissive of infra-red radiation generated by the lamps 5,6. The screen 7 is provided to protect the lamps 5,6 from mechanical damage and/or from soiling by food particles emanating from food during grilling.

Each lamp 5,6 has associated therewith an infra-red radiation reflector 8,9 which is preferably made of polished metal, such as aluminum or stainless steel, and which is preferably parabolic in cross-section.

One of the lamps 5 and its associated reflector 8 are shown in more detail in FIG. 2. The infra-red lamp 5 comprises a linear or coiled coil tungsten filament 10 supported within a tubular quartz envelope 11 by a number of spiral supports, such as at 12. Each end of the envelope 11 is closed by a pinch seal 13,14, within which the respective end of the filament 10 is electrically connected to an electrical flying lead 15,16, respectively, or alternatively to electrical spade connectors (not shown), for connection to a power supply.

Each pinch seal 13, 14 may be enclosed within a ceramic and cap (not shown in FIG. 2) to provide protection for the pinch seal.

The infra-red reflector 8 consists of a reflective portion 17, which is parabolic in cross-section and extends substantially along the length of the lamp 5, and two end faces 18,19 through which the respective ends of the lamp 5 extend. It is preferable that the filament 10 is positioned at the focus of the parabolic reflective portion 17.

Infra-red radiation generated by the lamps 5,6 is therefore either transmitted directly from the lamps through the screen 7 to the grilling surface provided by the tray 4 or the shelf 3, or firstly reflected by the reflectors 8,9 and then transmitted through the screen 7 to the grilling surface.

However, with the above arrangement alone, hot-spots tend to form on the grilling surface, thereby providing non-uniform grilling of food placed on the surface.

To alleviate this problem, a control arrangement (not shown in FIG. 1) is provided, which imparts oscillatory movement to the reflectors 8,9 by oscillating them through an angle of 25°–30° about a generally horizontal axis at the peak of the parabolic cross-section of the reflector, i.e. about axis 20 on reflector 8 and axis 21 on reflector 9.

By implementing this oscillatory movement of the reflectors, whilst maintaining the lamps in a fixed position relative thereto so that the lamps also oscillate, the reflected infra-red radiation is swept across the grilling surface, thereby achieving a substantially uniform distribution of intensity of infra-red radiation over the surface over a given length of time.

Alternative shapes of the reflectors may be utilised, such as one having a hemispherical cross-section, or the reflector may be shaped so as to redirect the beam of reflected infra-red radiation.

It may be preferable to utilise a facetted parabolic or other shaped reflector, which may facilitate manufacturing of the reflector.

Alternative types of movement of the reflectors, other than oscillatory, may also be implemented. The control arrangement may comprise a small two-pole motor or a synchronous motor to implement oscillatory movement, or it may consist of any other arrangement known to those skilled in the Art to provide the required movement of the reflector.

One suitable arrangement for controlling movement of the reflectors and lamps is shown in FIG. 3.

FIG. 3 shows an end view of two parabolic reflectors 22,23 accommodating tubular lamps 24, 25, similar to that shown in FIG. 2, mounted in the top of a grilling compartment 26 behind an infra-red-transmissive protective screen 27, as shown in FIG. 1, supported by supports 28, 29.

As shown in FIG. 3, each of the lamps 24, 25, has rectangular ceramic end caps 30,31, enclosing the pinch seal (not shown) at the ends of the lamp.

The reflectors 24, 25 are connected to pivots 32,33 respectively, about which the reflectors and lamps, which are fixed relative to the reflectors, are caused to oscillate. A small motor 34 causes a wheel 35 to rotate about its axis 36. A peg 37 is located off-centre on the wheel 35 and is constrained to slide in slot 38 at the end of a bar 39. The bar 39 is supported along, for example, a side wall (not shown) of the grill by two pegs 40,41, connected to the wall, which engage in slots 42,43 respectively of the bar 39. Each reflector 22, 23 is also provided with a peg 44, 45, which slides in slot 46, 47 of the bar 39.

In operation, the motor 34 rotates the wheel 35, which causes the peg 37 to move to the position shown in dotted lines at 48, thereby causing the bar 39 to slide so that slots 42, 43 move to positions 49, 50. As the pegs 44, 45 are constrained to move within the slots 46, 47, which move to dotted line positions 51, 52, the reflectors and lamps are thus constrained to pivot about the pivots 32,33, respectively. Further rotation of the wheel 35 then causes the peg 37 to return to its original position, and the reflectors and lamps are likewise returned to their original positions.

The motor 34 preferably causes the wheel 35 to rotate at about 8 r.p.m, thereby causing the reflectors and lamps to oscillate and thus sweep infra-red radiation emitted by the lamps across the grilling surface, as shown in FIG. 1, to provide a uniform distribution of intensity of infra-red radiation over the surface over a given length of time.

In the preferred arrangement, each lamp is fixed relative to its associated reflector, so that the lamp moves with the reflector. However, the lamp may alternatively remain fixed and the reflector move relative to the lamp. A fan (not shown) may be provided as a cooling means, in case the reflectors become overheated by the intense heat from the lamps, which typically operate at a temperature of approximately 2400 K.

The screen 7 is preferably removable from the compartment 1 to facilitate cleaning thereof.

The output of the lamps is preferably controlled by an energy regulator (not shown), which regulates the proportion of "on" periods to "off" periods of the lamps, in dependence on a required grilling temperature set by a user-operable control (not shown).

Alternatively a control arrangement for switching the lamps into various series and/or parallel configurations may be utilised to provide the selected temperature.

In an alternative embodiment, energisation of the lamps and movement of the reflectors may be controlled individually, so that, for example, only half of the grilling surface can be illuminated by the infra-red radiation by using only one lamp and its associated reflector, or alternatively both lamps could be energised, but with movement of only one reflector.

We claim:

1. A grilling arrangement including a grilling surface for supporting food to be grilled, a source of infra-red radiation for grilling said food, means for reflecting infra-red radiation generated by said source towards said grilling surface, and power driven means operative during grilling for imparting movement to said reflecting means so that during grilling said reflected radiation is swept across said surface to enhance the uniformity of distribution of intensity of infra-red radiation over said surface over a predetermined length of time, as compared with the degree of said uniformity that would prevail in the absence of said movement of said reflecting means.

2. An arrangement as claimed in claim 1 wherein said reflecting means is provided with a parabolic cross-section and said infra-red source is positioned at the focus of said parabola.

3. An arrangement as claimed in claim 2 wherein an oscillatory movement is imparted to said reflecting means about an axis at the peak of said parabolic cross-section.

4. An arrangement as claimed in claim 1 wherein the position of said infra-red source is fixed relative to said reflecting means, so that movement of said reflecting means causes movement of said infra-red source.

5. An arrangement as claimed in claim 1 wherein said infra-red source consists of a tubular tungsten-halogen lamp having a tungsten filament at the focus of said reflector, said reflector extending along substantially the length of said lamp.

6. An arrangement as claimed in claim 1 wherein said infra-red source and said reflecting means are mounted behind a protective screen of material transmissive of infra-red radiation, such that said reflected radiation is transmitted through said screen to said grilling surface.

7. An arrangement as claimed in claim 1 wherein said reflecting means if facetted to facilitate manufacture thereof.

* * * * *